United States Patent [19]

Ponzellini

[11] 4,033,543

[45] July 5, 1977

[54] DEVICE FOR ADJUSTING THE HEIGHT OF THE SEAT OF ARM-CHAIRS AND THE LIKE

[75] Inventor: Giulio Ponzellini, Bologna, Italy

[73] Assignee: Anonima Castelli S.p.A., Bologna, Italy

[22] Filed: July 15, 1975

[21] Appl. No.: 596,017

[30] Foreign Application Priority Data

Apr. 11, 1975 Italy ..... 49051/75

[52] U.S. Cl. ..... 248/412

[51] Int. Cl.² ..... F16M 11/00

[58] Field of Search ..... 248/404, 407–409, 248/411, 412; 297/345

[56] References Cited

UNITED STATES PATENTS

| | | | |
|---|---|---|---|
| 720,549 | 2/1903 | Adler | 248/412 |
| 2,658,777 | 11/1953 | Rauglas | 248/412 |

FOREIGN PATENTS OR APPLICATIONS

| | | | |
|---|---|---|---|
| 74,932 | 1961 | France | 248/412 |
| 1,449,684 | 1966 | France | 248/412 |
| 158,451 | 1957 | Sweden | 248/408 |
| 596,745 | 1948 | United Kingdom | 248/412 |
| 337,535 | 1930 | United Kingdom | 248/412 |

*Primary Examiner*—Lawrence J. Staab
*Attorney, Agent, or Firm*—Lackenbach, Lilling & Siegel

[57] ABSTRACT

A device for adjusting the height of the seat of an arm-chair and the like having a vertical hollow shaft fixed to the seat and telescopically received into a hollow base column and comprising a coaxial rod slidably received into said hollow shaft, on the upper end of which acts a control lever, said hollow shaft having an outer diameter smaller than the inner one of said column which at its upper part is provided with an inner bushing to support and guide said shaft while at its lower portion it carries a plug-like member having a conical outer surface and through which passes said rod, at the lower end of which is mounted a coaxial cylindric bowl having an outer diameter smaller than the inner diameter of said column and in which is arranged a crown of at least three radial holes to house small metal balls so that through said holes said balls can partially project outwardly, a first helical spring being mounted between said bowl and said plug member, while a second helical spring is mounted between an intermediate collar of said rod and the upper end of the plug member, said conical outer surface having its largest and smallest diameters such as to permit that this member in different axial positions with regard to the ball crown moves said balls towards the outside of the bowl into engagement with said column or vice versa, while a third spring is mounted to return the control lever to its inoperative position the shaft.

10 Claims, 4 Drawing Figures

9
A max
A min
8
23
2
1
4

9
A max
A min
8
23
2
1
4

DEVICE FOR ADJUSTING THE HEIGHT OF THE SEAT OF ARM-CHAIRS AND THE LIKE

The present invention relates to an improved device for adjusting the height of the seat plan of arm-chairs and the like and for securely fixing the parts thereof at their desired mutual position.

The device will be applied to the telescopically connecting system provided between the support hollow base of an air-chair and the seat thereof, said system comprising more particularly a hollow vertical column supported by radial legs and the like and a vertically hollow shaft telescopically received into said hollow column for vertical up and down movements and which is made integral at its upper end with the seat body. The device of this invention comprises a rod coaxial with said hollow shaft and received therein and which can be pushed downwards under the effect of the pressure arm of a control lever extending outwardly from said hollow shaft, which at lower end carries a plug-like member fixedly connected thereto and into which a vertical hole is provided through which said rod can freely pass, on the lower end of this latter a cylindric bowl being supported, provided at its side wall of shaped orifices to receive small metal balls so as to allow these latter to partially project out of the outer side sur-face of said bowl, within of said bowl said plug-member being located carrying an outer coaxial conical sleeve tapered downwardly and designed to push said balls towards the outside, a first compression spring being mounted between said plug member and the bowl and which tends to space said plug away from said bowl and to bring said balls to face the outer conical portion of said plug having higher diameters, a second spring being mounted on said plug-member between this latter and an abuting means or collar fixed to the rod, while a third spring is provided to maintain the control lever in its inoperative position.

According to a first embodiment the control lever acts upon the upper head of the rod of the device with the interposition of a control cap, while according to a variant said lever acts directly on said rod.

Locking devices are already known mounted between a hollow shaft and the hollow base column of an arm chair and the like, which are telescopically connected to one another, but said known devices has a small reliability, since their locking effect is entrusted to wedge means in which their correct positioning is critical and the friction produces clearances which are prejudicial for their correct operation.

Further said known devices are liable to jamming.

On the contrary, according to the present invention the locking effect is due to relative movements of a conical surface with regard to a crown of small metal balls, which are caused to move in unison radially towards the outside so that a locking system is thus obtained which has a centre axis so that during its assembling to no correct mutual angular positioning of the co-operating parts must be performed. Further, when said balls are not under any pushing effect, they act as conventional ball bearings for the hollow shaft so that the adjusting movements of the seat become secure and noiseless.

These and other characteristics and advantages of the device of the invention will be better understood from the following description of two embodiments thereof, taken in consideration together with the accompanying drawings, in which.

Figure 1:
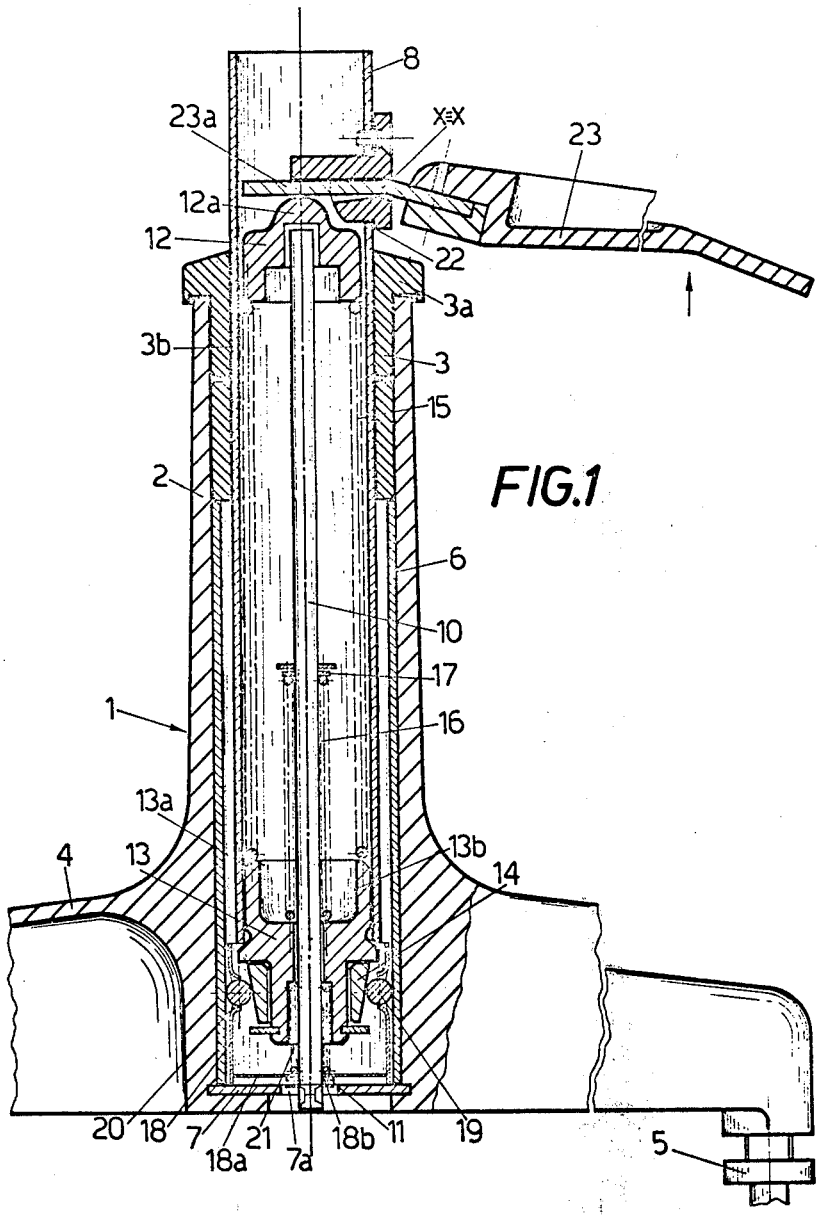
FIG. 1 shows the detail in enlarged scale of the axial section of the base of an arm-chair and of the hollow shaft telescopically received into the vertical hollow base column of the arm-chair where the device of this invention is mounted carried out according to a first embodiment.
Figure 2:
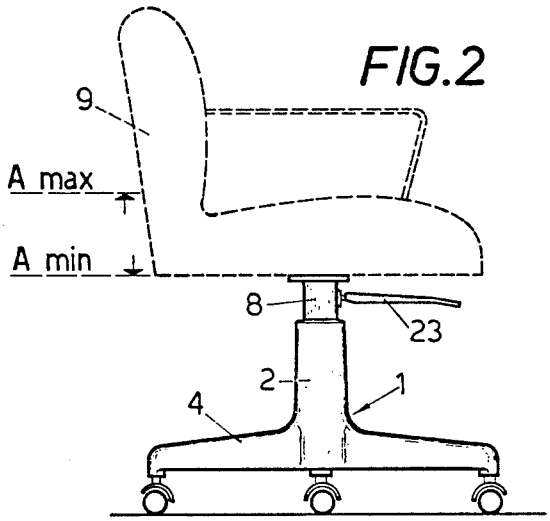
FIGS. 2 and 3 show the diagrammatic side view of the arm-chair in the position of minimum and maximum heigth respectively of the seat plan.
Figure 3:
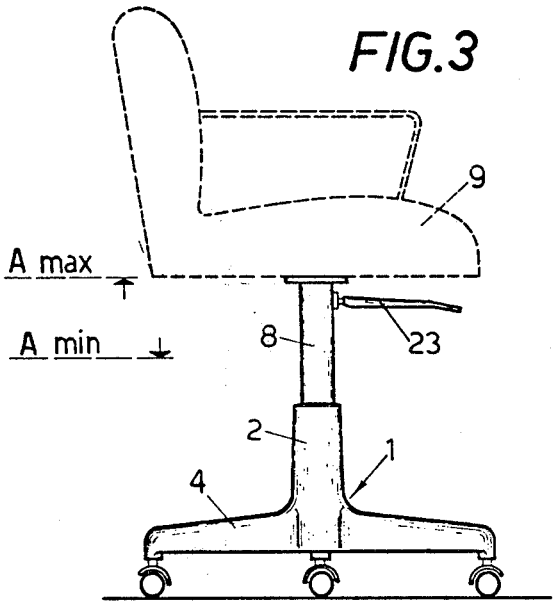

Now referring to the embodiment shown in FIGS. 1 to 3 generally indicates the support base of the air chair or the like, which comprises a central vertical hollow column 2 at the upper end of which is mounted a bushing 3 having an outwardly extending flange 3a resting on the upper edge of said column 2, which at its lower-part is made integral with radial legs 4 provided with feet 5 having an adjustable height or with other known supporting fixed or pivotable devices as caster wheels and the like.

The inner surface of the hollow column 2 is lined with a bearing surface, advantageously an anti-friction lining 6, while its bottom is closed by a disc 7 having a central orifice 7*a*. Within the column 2 and the upper bushing 3 is coaxially mounted an hollow shaft 8 having an outer diameter substantially equal to the inner diameter of the cylindric hole 3*b* of said bushing 3, but lesser than the inner diameter of the inner surface of the lining 6 so that between the lining 6 and the outer surface of the hollow shaft 8 a coaxial annular space is formed.

The length of the hollow shaft 8 is greater than that of the column 2 so that said shaft 8 as it is telescopically retracted into said column 2 has its end yet extending beyond said column 2, and can yet support the seat of the arm-chair 9, positioned at the minimum predetermined height (A min), but it can be raised up to a maximum height (A max) as shown in FIGS. 2 and 3. The present invention only concerns the automatic device provided to lock the base 1 and the hollow shaft 8 carrying the seat in their mutual desired position. Within the hollow shaft 8 a coaxial rod 10 is mounted provided at its upper end with a control cap 12 extending upwardly with a spherical head 12*a*, said cap housing the upper end of said rod 10 and having a circular cross section of a diameter slightly lesser than the inner diameter of the hollow shaft 8 so as to be able to move up and down with regard to it. At the lower end of the hollow shaft 8 is fixedly connected to a plug-member 13 carrying about its lower portion a conical annular body 14, mounted in any replacable manner into an annular seat arranged in the plug-member 13. A strong compression spring 15 is mounted between said cap 12 and the upper peripheral edge 13*a* of the plug-member 13, having a cup like inner cavity 13*b* against the bottom of which abuts the lower end of a second helical spring 16 abutting at its opposite end against a shoulder or collar 17 of the rod 10 and which can be obtained, for instance, by means of a washer fastened to said rod 10. About the lower end of the rod 10 on a disc or washer 11, fixed thereto to a cylindric bowl 18 carrying a ball retainer in the nature of a crown of small metal balls 19 is suspended, made of sheet-steel and into which drawn radial holes or upsetting orifices 20 are provided to receive and guide said balls 19 which may be at least three. Said balls 19 have such a size as to be able to be locked between the inner surface of the lining 6 and the outer surface of the conical body 14, thus forming a fastening means to make integral the hollow shaft 8 with the base column 1. The bottom 18*a* of said cylindric bowl 18 is bored by an axial hole 18*b* enabling the rod 10 to freely pass thereacross; between said bottom 18*a* and the plug body 13 is mounted the third helical spring 21. The first spring 15 is the strongest one and serves for compensating for any clearance between the cap 12 and the control lever 23*a*, while the spring 16 is stronger than the spring 21 and serves to push the bowl 18 carrying the balls 19 against the plug-member 13, while the spring 21 serves only to return the ball bowl 18 in its inoperative position. Therefore the conical outer surface of the annular body 14 supported by the plug-member 13 causes the balls 19 to be locked against the inner surface of the lining 6 of the column 2, thus making integral the hollow shaft 8 with the base column 2. At the level of the control cap 12 an orifice 22 is arranged through the side wall of the hollow shaft 8, through which enters the control arm 23*a* of the actuating lever 23 constituted of some parts only for construction purpose and/or to make easier its assembly. Said lever 23 rotates about the axis X—X and in its rest position has the position as shown in FIG. 1: said lever 23 is positioned just underneath the seat so that it cannot be seen and does not interfere with the movements of the arm chair during its use.

It will be now described the operation of the device according to the embodiment shown in FIGS. 1 to 3. In order to displace the seat from the minimum height (A min) as shown in FIG. 2 to any other higher height up to the maximum heigth (A max), as shown in FIG. 3, the user draws upwards the lever 23 in the direction of the arrow in FIG. 1. As a result of the rotating of said lever about the pivot axis X—X, the control arm 23*a* lowers pressing against the cap 12 which in turn forces the rod 10 to move downwards. Under the effect of the spring 21, abutting against the bottom 18*a* of the cylindric bowl 18, this latter can lower so that the small balls 19 can move back toward that portion of the conical body 14 which has smaller diameters, thus eliminating any locking effect between the conical body 14 and the lining 6. The hollow shaft 8 becomes thus free to move so that as the user acts again on the lever 23 in the direction of the arrow, said hollow shaft can be freely raised. After having attained the desired height, it is sufficient to release the lever 23, afterwards the rod automatically is moved upwards owing to the effect of the load of the springs 15 and 16 which restore the locking condition and recall the control lever 23 in its inoperative position.

Figure 4:
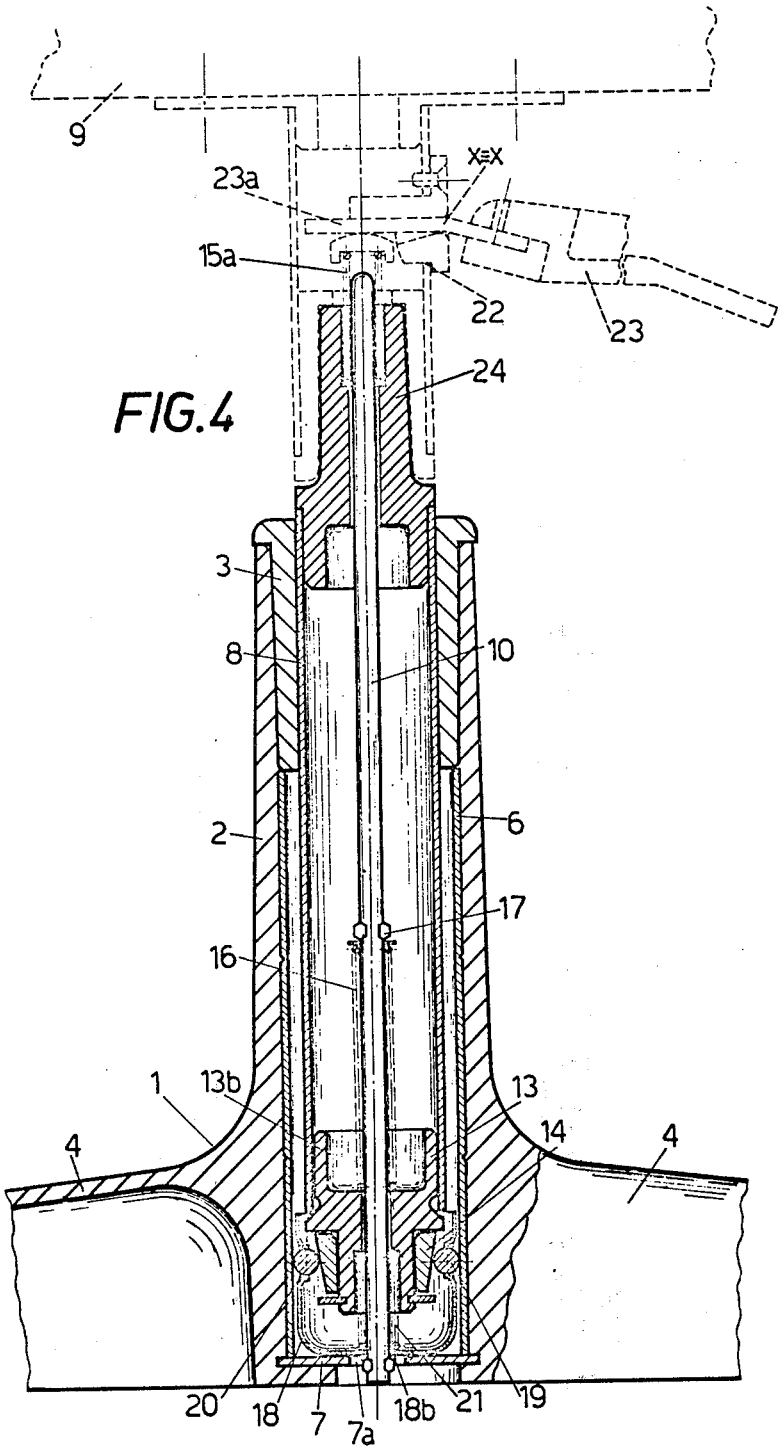
FIG. 4 shows the same detail of FIG. 1, but in the case wherein the device of the invention has been performed according to another embodiment.

In the variant shown in FIG. 4 the parts having the same functions, as those of the embodiment of FIGS. 1 to 3, are indicated by the same reference numbers. This embodiment only differs from the preceding on because the hollow shaft 8 carries an upper cap 24 made integral therewith. On said cap an annular coaxial seat 24*a* is arranged for partially housing the spring 15*a* which substitutes in its function the preceding spring 15. The upper end of the rod 10 passing through the cap 24 is put directly under the action of the control lever (not shown). The operation of this device is substantially the same as the preceding one, but in this embodiment the control lever is carried directly by the seat body.

What we claim is:

1. A device for adjusting the height of a seat of a chair or the like comprising a vertical hollow shaft fixed to the lower surface of the seat and depending therefrom; a base adapted to rest on a supporting surface and having a vertical hollow column dimensioned to telescopically receive said vertical shaft and provided on its inner surface with a bearing surface; a bushing provided at the upper end of said column dimensioned to guide said hollow shaft during its axial movements with respect to said column; a coaxial rod slidably received into said hollow shaft; control lever means movably mounted on said hollow shaft movable between operative and inoperative positions for axially displacing said coaxial rod relative to said hollow shaft; a plug member fixedly mounted on the lower end of said hollow shaft and provided with a central opening aligned with the axis of said hollow shaft and dimensioned to receive said coaxial rod therein for relative sliding movements therebetween, said plug member having a downwardly and inwardly directed tapered surface in the shape of a truncated conical body; a coaxial ball retainer means coupled to said coaxial rod and having a portion thereof disposed between said tapered surface and said bearing surface, said retainer means portion being provided with a plurality of angularly spaced radial holes; a plurality of balls each dimensioned to be partially received within one of said radial holes and adapted to abut against said tapered and bearing surfaces; a first spring acting between said retainer means and said plug member arranged to urge said balls towards the smaller diameter end of said tapered surface; a collar member mounted on an intermediate portion of said coaxial rod; a second helical spring acting between said collar member and the upper end of said plug member to urge said coaxial rod towards said control lever means, said conical body having its greatest and smallest diameters dimensioned to permit said plug member to radially move said balls into abutment against said bearing surface respectively with greater and smaller pressures when said coaxial rod and retainer means are lowered with respect to said plug member; and a third spring acting on said control lever means for urging said control level means to its inoperative position once said plug member and said hollow shaft are locked in position relative to said column.

2. A device as defined in claim 1, wherein said retainer means comprises a cylindrical bowl having an outer diameter smaller than the inner diameter of said column and having a circumferential crown on which said radial holes are provided.

3. A device as defined in claim 2, wherein said balls are partially received in said radial holes and partially radially project beyond said crown.

4. A device as defined in claim 1, wherein said bearing surface is an anti-friction surface.

5. A device as defined in claim 1, wherein said springs are helical compression springs.

6. A device as defined in claim 1, wherein said third spring is the strongest and exerts the greatest compression force.

7. A device as defined in claim 6, wherein said second spring is stronger than said first spring.

8. A device as defined in claim 1, wherein said retainer means is coupled to said coaxial rod by means of coupling means for preventing excessive downward movement of said retainer means relative to said coaxial rod but permitting unlimited downward movement of said coaxial rod relative to said retainer means, said first spring causing said retainer means to follow said coaxial rod when said hollow shaft is substantially unloaded, and permitting said coaxial shaft to move downwardly independently of said retainer means when said hollow shaft is loaded, whereby said retainer means remains locked between said bearing surface and said plug member when said control level means is inadvertently actuated to its operative position while a user is sitting on the chair or the like.

9. A device as defined in claim 1, wherein the upper end of said coaxial rod is provided with a cap slidably mounted in said hollow shaft, said third spring adapted to move said control lever means to its inoperative position being disposed between said cap and the upper end of said plug.

10. A device as defined in claim 1, wherein said hollow shaft is provided with an upper cap fixedly connected thereto, said cap having an axial hole arranged to slidably receive said coaxial rod, said third spring being mounted between said cap and said control lever means in order to move said control level means to its inoperative position.

* * * * *